US005713248A

United States Patent [19]

Franco

[11] Patent Number: 5,713,248

[45] Date of Patent: Feb. 3, 1998

[54] UNSCREWING DEVICE OF THREADED PLASTIC PLUGS

[75] Inventor: Rovedo Franco, Maniago, Italy

[73] Assignee: Del Col Lili, Pordenone, Italy

[21] Appl. No.: 640,694

[22] Filed: May 1, 1996

[30] Foreign Application Priority Data

May 2, 1995 [IT] Italy ..... PN9570020

[51] Int. Cl.[6] ..... B67B 7/18

[52] U.S. Cl. ..... 81/3.43; 81/64

[58] Field of Search ..... 81/3.4, 3.43, 3.44, 81/64, 185

[56] References Cited

U.S. PATENT DOCUMENTS

| | | | |
|---|---|---|---|
| 3,027,790 | 4/1962 | Wagner | 81/185 |
| 3,029,673 | 4/1962 | Godsey | 81/185 |
| 4,509,784 | 4/1985 | Vollers | 81/3.44 X |
| 4,604,920 | 8/1986 | Dupke | 81/64 |

*Primary Examiner*—James G. Smith
*Attorney, Agent, or Firm*—Wenderoth, Lind & Ponac

[57] ABSTRACT

An unscrewing device for threaded plastic plugs applied to bottles has a handle formed by a suitably shaped longitudinal element (11). A cylindrical ring (12) departs from the end of the handle, and is interrupted over a suitable length (T) by a free end in proximity to the end of the element (11) from which it extends. A curved element (13) extends outward from the free end and is directed in an opposite direction, practically forming a trigger. Inside the cylindrical ring (12) can be inserted in succession reduced rings (22, 32) that are also interrupted over suitable lengths (T1–T2) and that present diameters that progressively decrease. The plug to be unscrewed is inserted in the internal holes of the rings (12, 22, 32). The user grips the longitudinal element (11) and pulls on the trigger (13) with the index finger, producing scarfing so that rotating the longitudinal element (11) around the axis of the plug unscrews the plug.

8 Claims, 2 Drawing Sheets

UNSCREWING DEVICE OF THREADED PLASTIC PLUGS

BACKGROUND OF THE INVENTION

The present invention relates to a device particularly usable to facilitate the unscrewing of threaded plastic plugs usually applied to bottles, such device permitting, moreover, use over a great range of diameters of such plugs.

Threaded plastic plugs are variously used particularly to stop glass of plastic bottles.

A widespread use of these plastic plugs is to plug plastic bottles containing mineral water, various drinks or other liquids. As is known, often the plugs, for various reasons, are difficult to unscrew by only a simple grip, and at times are even impossible to open this way, requiring the use of various, and always inappropriate, means to open the bottles that involve complicated maneuvers and that often cause breakage, and anyhow have various drawbacks.

SUMMARY OF THE INVENTION

The object of the present invention is to obviate the difficulties and drawbacks mentioned above. This object is obtained by a device according to the present invention.

More particularly, the objects of the present invention are obtained by an unscrewing device for unscrewing threaded plastic plugs. An elongate handle member has a distal end, and an annular member extends from the distal end. The annular member substantially forms a cylindrical ring that has a first end at which the annular member is connected to the distal end of the elongate member and a free end. The free end is spaced by a discrete length from the first end. The annular member has a notched interior surface for gripping an exterior surface of the threaded plastic plug. Furthermore, a trigger member extending outwardly from the free end of the annular member curves in a direction away from the elongate handle member. At least one interior reduced ring, having a diameter smaller than the annular member, is adapted to be inserted in the annular member. Each such ring has an interrupted circumference so that each ring has opposite ends spaced apart from each other and a notched interior surface for gripping an exterior plastic surface of a threaded plastic plug.

BRIEF DESCRIPTION OF THE DRAWINGS

To better understand the characteristics and advantages of the present invention and its use, by way only of example and not in a limiting manner, a preferred embodiment is described below with reference to the accompanying drawings, in which.

In the figures common parts are represented by the same reference numerals.

DETAILED DESCRIPTION OF THE PREFERRED EMBODIMENT

Figure 1:
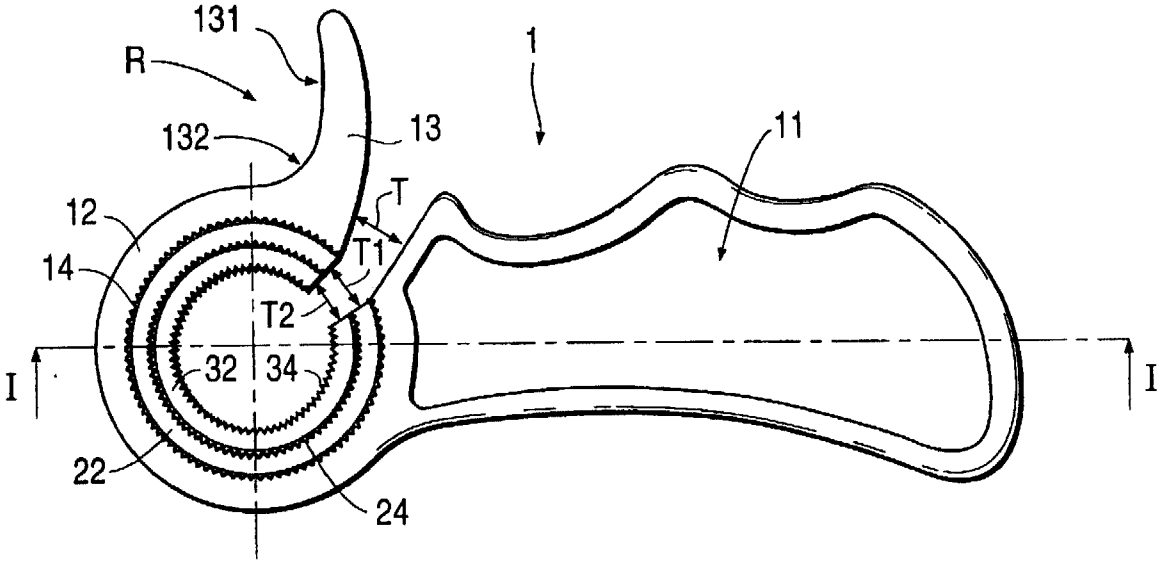
FIG. 1 shows a plan view of a device that is the object of the present invention.
Figure 2:
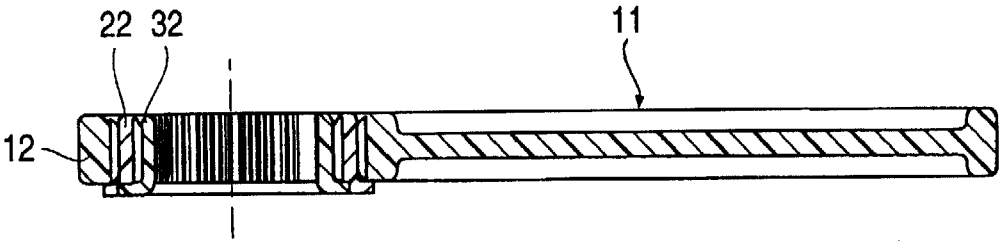
FIG. 2 is a sectional view taken along line I—I of FIG. 1.
Figure 3:
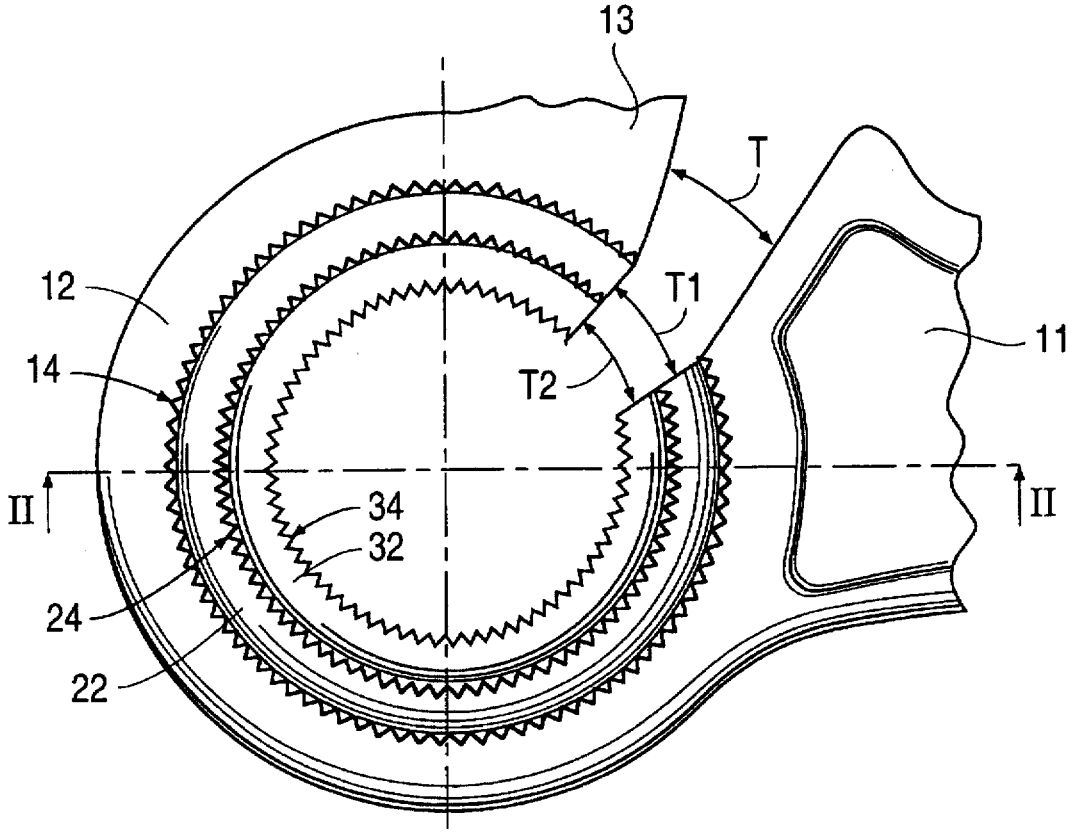
FIG. 3 is an enlarged view of a detail of a gripping part for a plug of the device of FIG. 1.

With reference particularly to FIGS. 1 and 2, it is noted that a device 1 that is the object of the present invention is fundamentally constituted by a longitudinal element 11 that is suitably shaped so as to form a handle. From an end of the handle extends a substantially annular element forming practically a cylindrical ring 12 that is interrupted over a discrete length T. The free end of the ring 12 is in proximity to the same end of the element 11 from which the ring 12 departs. From the free end, an exterior and fairly curved element 13 extends outward. The free end of the element 13 is turned in an opposite direction to the element 11. This element 13 has an internal concave part 131 that connects to the external edge of the cylindrical ring 12 with a suitable radial part 132. The element 13 is thus shaped substantially as a trigger.

The internal surface of the cylindrical ring 12 is suitably notched by a plurality of light indentations 14 able to engage themselves in the corresponding indentations that are usually formed on the external cylindrical surface of plugs. Inside the cylindrical ring 12, it is possible to insert at least a first reduced cylindrical ring 22 and, if necessary, on the inside of ring 22 a second reduced cylindrical ring 32 can be provided.

Figure 4:
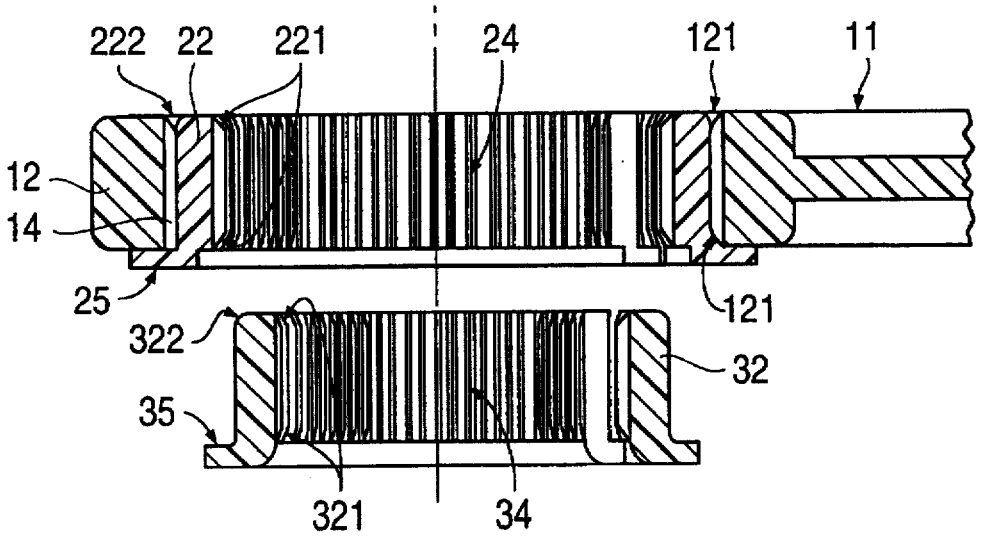
FIG. 4 is a sectional view taken along line II—II of FIG. 3, equivalent to the sectional view taken along line I—I of FIG. 2.

In FIG. 4, for clarity, the first reduced ring 22 is illustrated in an inserted position, while the second reduced ring 32 is illustrated in an external position, i.e. before insertion. Both the reduced rings 22 and 32 obviously are interrupted in such a way as to present relative discrete interruption lengths T1 and T2, respectively. Also, the inside surfaces of the reduced rings 22, 32 will be suitably notched like the cylindrical ring 12 by respective light indentations 24 and 34. Preferably, from one of the lateral edges of each of the reduced rings 22, 32, respective small flanges 25 and 35 will protrude outward.

The cylindrical ring 12 will have a fairly thin radial thickness, equal to about half of its length in the axial direction (in practice about 4 mm) so as to obtain a sufficient mechanical resistance of the same as well as a suitable elastic deformation. The radial thicknesses of the reduced cylindrical rings 22, 32 are also fairly thin (about 3 mm) so as to also permit them to have a suitable elastic deformation.

The first and second reduced rings 22, 32 have external diameters equal to the internal diameters of the cylindrical ring 12 and the first reduced ring 22, respectively, so that the first reduced ring 22 can be inserted in the cylindrical ring 12, and the second reduced ring 32 can be inserted, in turn, in the first reduced ring 22.

The flanges 25 and 35 of the reduced rings 22, 32 have the function of stopping the insertion of the reduced rings in the correct position of application, preventing them from escaping. Moreover, insertion of the reduced rings 22, 32 is accompanied by a suitable interference so that the reduced rings 22 and 32, when applied, remain fixed, even if they can be easily taken out.

It is pointed out, incidentally, that the circular edges of the internal hole of the cylindrical ring 12, as well as the external and internal circular edges resulting in the axial ends of the reduced rings 22, 32, will be preferable radiused or rounded as shown at 121, 221, and 321 on the inside, and 222 and 322 on the outside. This facilitates the engagement of the rings 12, 22, and 32 with each other, as well as facilitating the insertion of the plugs to be unscrewed.

The device 1 and the reduced rings 22 and 32 are formed simply by molding a suitable plastic material.

The detailed description of the device that is the object of the present invention has been completed, and here below is described its use.

The user first of all will adapt the device to the plug to unscrew. To do this operation, if the diameter of the plug coincides with or is slightly smaller than the diameter of the cylindrical ring 12, both the reduced rings 22 and 32 are taken away. The cylindrical ring 12 is then mounted on the plug, and the user grips the element 11 by putting the index finger in the internal concave part (131 and 132) of the element 13. At this point, the user pulls the element 13 with the index finger toward the element 11, as clearly indicated in FIG. 1 by the arrow R, causing consequently a reduction of the interrupted length T of the cylindrical ring 12, which will elastically warp, shortening the diameter to engage the indented internal surface 14 with the external surface of the plug. This causes a remarkable scarfing that prevents every reciprocal slip when the whole device 1 is successively rotated around the axis of the plug to unscrew it.

If the plug has a diameter that can't be clamped by the cylindrical ring 12, the user will insert the first reduced ring 22, and eventually also the second reduced ring 32, until reaching the external diameter of the plug in question, and then will proceed to unscrew the plug in the way described above. The reduced rings 22 and 32 can run reciprocally in a circle between themselves as well as to the cylindrical ring 12 that contains them so that practically the clamping force R hasn't appreciable increases.

It is pointed out that the reduced rings 22 and 32, as they can run reciprocally, can be applied by placing them with their interruption lengths T1 and T2 in every position. Moreover, given the symmetry of the opposite faces of the device 1, and particularly of the hole of the cylindrical ring 12, the insertion in the hole of the reduced rings 22 and 32 can happen from both axial faces. Thus the device 1 can be applied on a plug to unscrew in two symmetrically opposite ways, permitting it also to be used advantageously by left-handers. At the conclusion of the use, one or both of the reduced rings 22 and 32 eventually removed for the use can be reinserted, avoiding detached parts and consequently their possibly being mislaid.

The device 1 that is the object of the present invention clearly permits not only the remarkable advantage of unscrewing plugs from bottles when they are fixed in such a way that they can't be removed using only the hands, but also permits such an operation on plugs having various diameters.

Clearly the diameter of the cylindrical ring 12, of about 32 mm, can be increased to permit the use of the device 1 on plugs having greater diameters. Moreover, the number of the reduced cylindrical rings can be greater, increasing the diameter range of the plugs on which it will be possible to operate.

It is well understood that it will be possible to bring these and other variations to the device that is object of the present invention without going out of the context of what is described, and hereinafter claimed, with reference to the enclosed drawings and from the scope of the present patent right.

I claim:

1. An unscrewing device for unscrewing threaded plastic plugs, comprising:

an elongate handle member having a distal end;

an annular member extending from said distal end of said elongate handle member, said annular member substantially forming a cylindrical ring and having a first end at which said annular member is connected to said distal end of said elongate handle member and a free end spaced by a discrete length from said first end, said annular member having a notched interior surface for gripping an exterior surface of a threaded plastic plug;

a trigger member extending outwardly from said free end of said annular member and curving in a direction away from said elongate handle member; and at least one interior reduced ring having a diameter smaller than said annular member and adapted to be inserted into said annular member, each said at least one interior reduced ring having an interrupted circumference such that each said at least one interior reduced ring has opposite ends spaced apart from each other and a notched interior surface for gripping an exterior surface of a threaded plastic plug.

2. The unscrewing device of claim 1, wherein said at least one interior reduced ring comprises two reduced rings having progressively smaller diameters such that one of said two reduced rings can be directly inserted into said annular member and such that the other of said two reduced rings can be inserted into said annular member by being inserted into the one of said two reduced rings when the one of said two reduced rings is inserted into said annular member.

3. The unscrewing device of claim 2, wherein interior circular edges of said annular member and exterior and interior circular edges at axial end faces of each said at least one interior reduced ring are rounded.

4. The unscrewing device of claim 2, wherein each said at least one interior reduced ring comprises an external circumferential face for engagement with one of said notched interior surface of said annular member and said notched interior surface of another said at least one interior said external circumferential face from one end thereof so as to form a stop for stopping insertion of each said at least one interior reduced ring.

5. The unscrewing device of claim 1, wherein interior circular edges of said annular member and exterior and interior circular edges at axial end faces of each said at least one interior reduced ring are rounded.

6. The unscrewing device of claim 1, wherein each said at least one interior reduced ring comprises an external circumferential face for engagement with one of said notched interior surface of said annular member and said notched interior surface of another said at least one interior reduced ring and a flange protruding radially outwardly of said external circumferential face from one end thereof so as to form a stop for stopping insertion of each said at least one interior reduced ring.

7. The unscrewing device of claim 1, wherein each said at least one interior reduced ring has a diameter such that, when said annular member and said at least one interior reduced ring are in a free and uncompressed state, insertion of one of each said at least one interior reduced ring into said annular member or into another of each said at least one interior reduced ring already inserted into said annular member causes an interference fit such that each said at least one interior reduced ring is held in said annular member by friction.

8. The unscrewing device of claim 1, wherein said elongate handle member is longer than said trigger member, said elongate handle member being sized to fit the human hand, and said trigger member being sized to fit a human index finger.

* * * * *